US010828230B2

(12) United States Patent
Möbius et al.

(10) Patent No.: US 10,828,230 B2
(45) Date of Patent: Nov. 10, 2020

(54) APPARATUS FOR GENERATING SHOCK WAVES

(71) Applicant: CELLVITALIS HOLDING GMBH, Kreuzlingen (CH)

(72) Inventors: Andreas Möbius, Constance (DE); Axel Voss, Bad Schwartau (DE); Ralph Brinkmann, Triboltingen (CH)

(73) Assignee: CELLVITALIS HOLDING GMBH, Kreuzlingen (CH)

( * ) Notice: Subject to any disclaimer, the term of this patent is extended or adjusted under 35 U.S.C. 154(b) by 554 days.

(21) Appl. No.: 15/376,956

(22) Filed: Dec. 13, 2016

(65) Prior Publication Data

US 2017/0172843 A1 Jun. 22, 2017

Related U.S. Application Data

(60) Provisional application No. 62/268,695, filed on Dec. 17, 2015.

(51) Int. Cl.
*A61H 23/00* (2006.01)
*A61H 23/02* (2006.01)

(52) U.S. Cl.
CPC ..... *A61H 23/008* (2013.01); *A61H 23/004* (2013.01); *A61H 23/02* (2013.01); *A61H 2201/0153* (2013.01)

(58) Field of Classification Search
CPC .. A61H 23/008; A61H 23/02; A61H 23/0218; A61H 23/0236; A61H 23/0245; A61H 23/0254; A61H 23/0263; A61H 2023/0209; A61H 2023/0272; A61H 2023/0281; A61H 2023/029; A61B 17/225; A61B 17/2251; A61B 17/2253; A61B 17/2255; A61B 17/2256; A61B 17/2258
USPC ..... 601/4, 48
See application file for complete search history.

(56) References Cited

U.S. PATENT DOCUMENTS

| | | | | |
|---|---|---|---|---|
| 5,941,838 | A * | 8/1999 | Eizenhofer | G10K 9/12 367/175 |
| 6,217,531 | B1 * | 4/2001 | Reitmajer | G10K 15/06 601/4 |
| 7,695,443 | B2 * | 4/2010 | Voss | A61H 23/008 600/437 |
| 2007/0239083 | A1 * | 10/2007 | Voss | A61H 23/008 601/4 |
| 2009/0088670 | A1 * | 4/2009 | Warlick | A61B 17/2251 601/4 |
| 2013/0345600 | A1 * | 12/2013 | Katragadda | A61H 23/008 601/4 |

* cited by examiner

*Primary Examiner* — Bradley H Philips
*Assistant Examiner* — Vincent D Hoang
(74) *Attorney, Agent, or Firm* — Seyfarth Shaw LLP; Brian Michaelis

(57) ABSTRACT

The present disclosure relates to a device for generating shock waves that includes an interchangeable applicator head for generating shock waves for treatment of human or animal bodies, which applicator head includes a reflection or focusing mechanism, two electrode tips for producing a spark gap, and a membrane, which together with the reflection or focusing mechanism encloses a fluid medium that is designed to generate a plasma when a voltage between 1 kV and 30 kV is applied. According to the disclosure, the applicator head is electrically and mechanically connected to a hand-held apparatus in a detachable manner.

13 Claims, 2 Drawing Sheets

APPARATUS FOR GENERATING SHOCK WAVES

CROSS-REFERENCE TO RELATED APPLICATIONS

This application claims priority to U.S. Provisional Patent Application Ser. No. 62/268,695, filed Dec. 17, 2015, all of which is incorporated herein by reference.

BACKGROUND

Shock waves are used in human and veterinary medicine for various purposes. Shock wave applicators are traditionally connected to a control unit via an electrical high-voltage connection. Control units may be in the form of table-top equipment or mobile, transportable equipment. Medical applications of these devices are the treatment of hard and soft tissues, in particular to stimulate bone growth and encourage healing in painful orthopaedic medical conditions (e.g. tennis elbow, heel spurs, calcific tendonitis of the shoulder), therapeutic treatment of nerves, muscles and other soft tissue structures, stimulation of blood flow and treatment of acute and chronic inflammation in human or animal tissue.

Conventional shock wave applicators, in particular electrohydraulic applicators, comprise a hand-held apparatus, which is permanently or detachably connected to the control unit. The hand-held apparatus contains, in a non-detachable manner, an applicator head consisting of a reflector, which contains a fluid medium and is sealed by a membrane, and two electrode tips. The shock wave applicator can only be replaced by also detaching from the control unit the electrical and mechanical connection, usually in the form of a cable, as a unit together with the applicator head and hand-held apparatus. The parts subject to wear in these systems consist of at least the two electrode tips and usually also the fluid medium surrounding the tips. Since the electrode tips must be connected to the voltage supply cable such that the current discharged by the voltage can flow with minimum possible obstruction, the connection in conventional electrohydraulic systems consists of a screw, crimp, and/or solder connections, by means of which the applicator head is connected in a non-detachable manner to the hand-held apparatus, the cable, and the coupling to the supply unit.

Thus, in order to replace parts subject to wear, such as the electrode tips and the fluid medium surrounding the tips, the entire hand-held apparatus including the connecting cable must be replaced. Since parts that are not necessarily subject to wear (e.g., the hand-held apparatus, cable, and coupling) always need to be sent as well with the parts subject to wear to be replaced, the weight and space required, as well as costs of storing, transporting and shipping the parts, which often need to be dispatched in large quantities, are considerable. Furthermore, the parts subject to wear can only be replaced using a special tool.

SUMMARY

The present disclosure describes an improved device for generating shock waves in a fluid medium, in particular for generating electrohydraulic shock waves. The device has an interchangeable applicator head, thereby making it simpler to replace the applicator head and the parts subject to wear contained in the head. The applicator head according to the present disclosure comprises a reflector, a fluid medium, two spark electrode tips and a membrane, and also an electromechanical coupling facility. The applicator head according to the present disclosure is designed such that it is electrically and mechanically connected to a hand-held apparatus in a detachable manner. According to the disclosure, the applicator head is intended to facilitate easy replacement in the manner of a light bulb, and thereby allow a user to be able to use a plurality of identical or different applicator heads and to save space for storing the heads.

The system for generating shock waves has an interchangeable applicator head for generating shock waves for treatment of human or animal bodies. The applicator head comprises a reflection or focusing mechanism, two electrode tips for producing a spark gap, and a membrane, which together with the reflection or focusing mechanism encloses a fluid medium that is designed to generate a plasma when a voltage between about 1 kV and about 30 kV is applied. According to the present disclosure, the applicator head is electrically and mechanically connected to a hand-held apparatus in a detachable manner.

Different or identical applicator heads can be detachably connected to the hand-held apparatus, and therefore can also be stored separately, for instance. The applicator heads can thus have different reflector geometries, power values and dimensions, suited for various applications. It can be beneficial to have target areas and penetration depths of different dimensions, for example. A procedure for generating different emission patterns is to shift an electrode gap out of a primary focus of a semi-ellipsoid reflector, which results in an unfocused and distorted image of the primary focus in a secondary focus.

BRIEF DESCRIPTION OF THE DRAWINGS

For a more complete understanding of the present disclosure, reference is now made to the following description taken in conjunction with the accompanying drawings.

DETAILED DESCRIPTION

Figure 1:
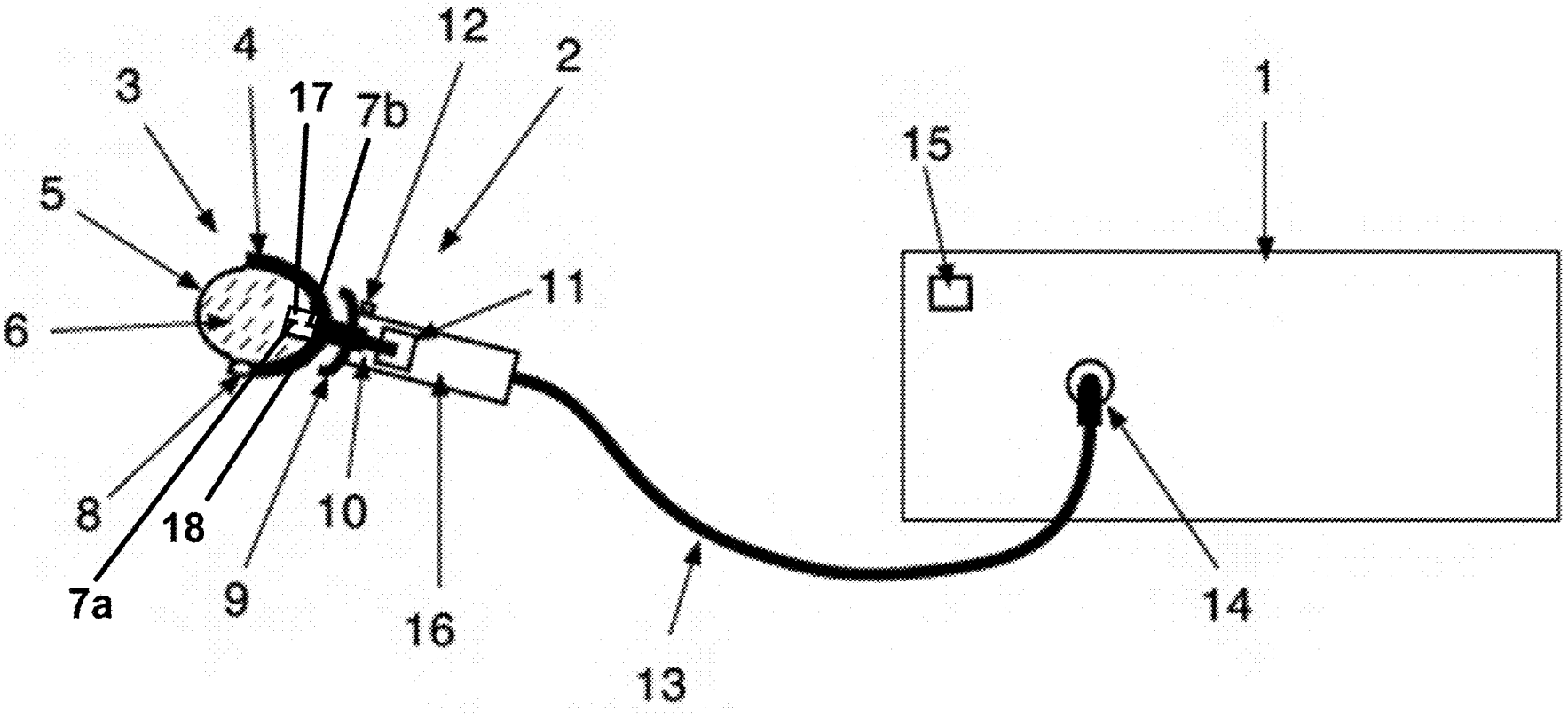
FIG. 1 illustrates a control unit in the form of a table-top unit having a hand-held apparatus according to embodiments of the present disclosure.

FIG. 1 shows a system for generating shock waves in a fluid medium. The system includes a table-top control unit 1 coupled to a hand-held apparatus 2, and an applicator head 3 coupled to the hand-held apparatus 2. The hand-held apparatus 2 couples to the control unit 1 via a connecting cable 13 that detachably couples to a high voltage plug-in connection 14 of the control unit 1.

The control unit 1 includes a read/write device 15 that communicates with a communication/storage medium 8 of an applicator head 3. The read/write device 15 communicates with the communication/storage medium 8 to identify a type and power values of the applicator head 3. Unique identification of various applicator heads 3 by the control unit 1 is advantageous in order to eliminate confusion over the types or power values, or to detect the wear of the applicator heads 3 or to allow the control unit 1 to be able to assign different power values to the different applicator heads 3. The communications/storage medium 8 may communicate data to and from the control unit 1 (i.e., the read-write device 15) via electrical transmissions through the connecting cable 13 or via contactless transmissions. Such data may be transmitted via radio frequencies, or other frequencies.

The hand-held apparatus 2 comprises an electro-mechanical connection 10, a handle 16, an applicator-head receptacle/mechanical plug-in connection 9, and an interlock mechanism 11, which can accommodate the applicator head 3. The interlock mechanism 11 may be housed in the hand-held apparatus 2. The interlock mechanism 11 allows an applicator head 3 to be replaced. The hand-held apparatus 2 also provides a trigger button 12 for triggering shock waves.

The applicator head 3 may be electrically or mechanically connected to the hand-held apparatus 2 in a detachable manner. The applicator head 3 may be detached from the hand-held apparatus 2, while the hand-held apparatus 2 remains coupled to the control unit 1 via the connecting cable 13 and the high voltage plug-in connection 14. It may be beneficial for the interchangeable unit to consist of just the applicator head 3 and does not consist of the hand-held apparatus 2, connecting cable 13 and electro-mechanical plug-in connection (described below) as previously done. The interchangeable unit of the present disclosure has a space-saving and lightweight design for this purpose, and others.

Figure 2:
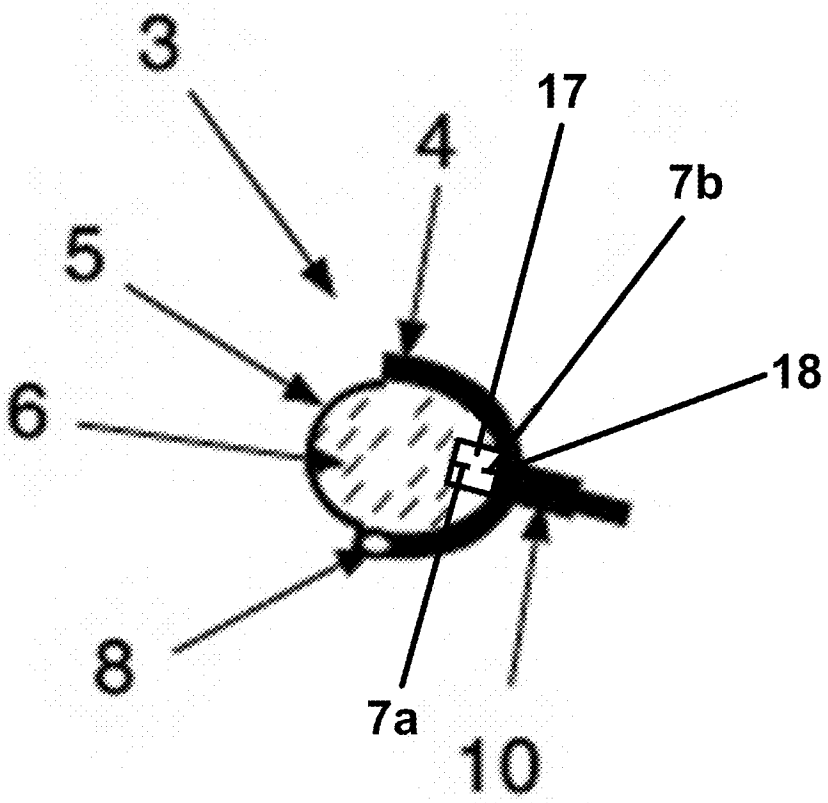
FIG. 2 illustrates an applicator head according to embodiments of the present disclosure.

FIG. 2 shows the interchangeable applicator head 3, which comprises a reflector 4 (e.g., a focusing mechanism), a membrane 5, electrodes 7*a* and 7*b* that produce a spark gap, the communications/storage medium 8, an electrical connection 10, and the fluid medium 6, which is enclosed by the membrane 5 and the reflector 4. An electrohydraulic shock-wave is generated when a high voltage is discharged across the two spark electrodes (or electrode tips) 7*a* and 7*b* in the fluid medium 6 (which may contain water). The hand-held apparatus 2 supplies the high voltage to the applicator head 3 when the button 12 is engaged. During the discharge, a current channel is formed between the two electrode tips 7*a* and 7*b*, which initially causes intense heating of the fluid medium 6 and then, as a result, the formation of a plasma bubble. The expansion and subsequent collapse of the plasma bubble produce a large rise in pressure followed by a drop in pressure in the fluid medium 6. The result is a pressure wave, which is known as the shock wave, which contains a short positive compressive component followed by a more prolonged negative tensile component and which propagates in the fluid medium 6. The reflector 4 (which may be metallic) reflects the shock wave to the outside via the transmissive membrane 5.

The shock wave produced by the present disclosed system may be used in human and veterinary medicine for various purposes. Medical applications of the system are the treatment of hard and soft tissues, in particular to stimulate bone growth and encourage healing in painful orthopaedic medical conditions (e.g. tennis elbow, heel spurs, calcific tendonitis of the shoulder, etc.), therapeutic treatment of nerves, muscles and other soft tissue structures, stimulation of blood flow and treatment of acute and chronic inflammation in human or animal tissue. It may beneficial for mobile use to be able to use applicators intended for different therapeutic requirements.

The reflector 4, or reflector mechanism, may have an ellipsoid shape, paraboloid shape, or another shape that enables the reflector 4 to engage the membrane 5 to enclose the fluid medium 6. The reflector 4 and the membrane 5 may be a sealed unit. The fluid medium 6 may generate a plasma when a voltage is applied thereto. The voltage may be between about 1 kV and about 30 kV, preferably about 5 kV to about 20 kV. The electrodes 7*a* and 7*b* (or electrode tips) may be housed in an ignition device 17. The ignition device 17 may be coupled to the control unit 1 by the electro-mechanical plug-in mechanism 10. The ignition device 17 may also be plugged or screwed into the reflector such that the electrode tips 7*a* and 7*b* are surrounded by the fluid medium 6.

The applicator head 3 is designed such that it electrically and mechanically detaches from the hand-held apparatus 2. The applicator head 3 can provide an inlet 18 for adding and taking out the fluid medium 6. At least one of the two electrode tips 7*a* and 7*b* is subject to wear such that this electrode may have, at an end outside the fluid medium, a connection that allows good electrical conduction, and at the other end may have a mechanically tight seal against the fluid medium to prevent the aqueous medium from escaping.

By virtue of the detachable interface lying close to the electrode tips 7*a* and 7*b* and the fluid medium 6, i.e., close to the parts subject to wear, it is possible to reduce the size and the weight of the interchangeable applicator head 3. It is easier to replace the applicator head 3 of the present disclosure because there is no need to replace the entire unit consisting of the hand-held apparatus 2, cable 13 and cable plug 14 at the user's site. Instead, the user can quickly and easily replace just the applicator head 3. This also allows the user to replace the applicator head 3 quickly and easily for different treatment functions. The same cable 13 and plug 14, which does not depend on the treatment function, may always remain locally on the control unit 1. Since only one control unit/supply unit 1 and one hand-held apparatus 2 are needed for the different applicator heads 3 having different shock wave characteristics, the production costs, the transport and shipping costs, the storage space and the weight of the interchangeable applicator heads 3, which often need to be sent all over the world in large quantities, are minimized. Furthermore, the applicator head 3 can be detached without using a tool. A reliable electrically conductive connection and a reliably sealed applicator head 3 are possible despite the detachable connection for quick and easy replacement of the applicator head 3. The detachable electrical connection is designed to allow a large number of mating cycles and there is minimal to no risk of escaping fluid medium 6 when either replacing or transporting the applicator heads 3.

To replace the parts subject to wear in the applicator head 3, the ignition unit (which may be screw-connected to the applicator head 3) may be replaced without using a special tool, and the applicator head 3 may then be filled with new medium 6. This dispenses with undoing numerous mechanical and electrical screw connections. The ignition units can be collected, and prepared for reuse in a separate operation.

In order to prevent accessible high voltage from posing a risk to users and people, electrical safety regulations stipulate the implementation of preventive measures for ensuring live electrical parts are inaccessible. One way of achieving this is to monitor and provide interlocking for the detachable connection. According to the present disclosure, this interlocking may be performed in the hand-held apparatus 2 to ensure that the applicator head 3 cannot be detached while a high voltage is present on accessible parts of the hand-held apparatus 2.

Although illustrative embodiments of the present disclosure have been described herein with reference to the accompanying drawings, it is to be understood that the present disclosure is not limited to those precise embodiments, and that various other changes and modifications may be made by one skilled in the art without departing from the scope or spirit of the disclosure.

What is claimed is:

1. An interchangeable applicator head for use with a system for generating shock waves for treatment of human or animal bodies, comprising:

a reflection mechanism;

an applicator-head receptacle with mechanical plug-in connection attached to the reflection mechanism and configured to engage an interlock mechanism housed in a hand-held apparatus of the system for generating shock waves, the interlock mechanism being configured to ensure that the applicator head cannot be detached while a high voltage is present on accessible parts of the hand-held apparatus;

a detachable ignition device detachable from the reflection mechanism, the detachable ignition device comprising two electrode tips that produce a spark gap; and a membrane, the membrane and reflection mechanism enclosing a fluid medium, the fluid medium generating a plasma when a voltage between about 1 kV and about 30 kV is applied to the fluid medium, the interchangeable applicator head comprising an inlet for adding and taking out the fluid medium.

2. The interchangeable applicator head according to claim 1, wherein the reflection mechanism is ellipsoid in shape.

3. The interchangeable applicator head according to claim 1, wherein the reflection mechanism is paraboloid in shape.

4. The interchangeable applicator head according to claim 1, further comprising a storage medium in communication with a read/write device, the storage medium in electronic communication with a control unit to identify the interchangeable applicator head, and the detachable ignition device coupled to the control unit by an electro-mechanical plug-in mechanism.

5. The interchangeable applicator head according to claim 4, wherein the storage medium is connected to the control unit via one of a wired or wireless connection.

6. The interchangeable applicator head according to claim 4, wherein data is transferred between the communication/storage medium and the control unit via radio frequencies.

7. The interchangeable applicator head according to claim 1, wherein the voltage is between about 5 kV and about 20 kV.

8. The interchangeable applicator head according to claim 1, wherein the reflection mechanism and the membrane are a sealed unit.

9. A system for generating shock waves for treatment of human or animal bodies, comprising:

a control unit;

a hand-held apparatus in communication with the control unit;

an interlock mechanism housed in the hand-held apparatus, the interlock mechanism being configured to ensure that the applicator head cannot be detached while a high voltage is present on accessible parts of the hand-held apparatus; and an applicator head being one of electrically or mechanically connected to the hand-held apparatus in a detachable manner via the interlock mechanism, the applicator head comprising:

a reflection mechanism;

a detachable ignition device detachable from the reflection mechanism, the detachable ignition device comprising two electrode tips that produce a spark gap, and the detachable ignition device coupled to the control unit by an electro-mechanical plug-in mechanism; and a membrane, the membrane and reflection mechanism enclosing a fluid medium, the fluid medium generating a plasma when a voltage between approximately 1 kV and approximately 30 kV is applied to the fluid medium, the applicator head comprising an inlet for adding and taking out the fluid medium.

10. The system according to claim 9, wherein the hand-held apparatus is in communication with the control unit via a connecting cable and a high-voltage plug.

11. The system according to claim 9, wherein the hand-held apparatus includes a button for triggering shock waves.

12. The system according to claim 9, wherein the hand-held apparatus includes the interlock mechanism housed in the hand-held apparatus configured to engage an applicator-head receptacle with mechanical plug-in connection to ensure that the hand-held apparatus cannot be detached while a high voltage is present on accessible parts of the hand-held apparatus.

13. The system according to claim 9, wherein the applicator head is coupled to the control unit via a detachable connection, and wherein the control unit is a portable table-top unit.

* * * * *